US005673655A

United States Patent [19]

Mishima

[11] Patent Number: 5,673,655

[45] Date of Patent: Oct. 7, 1997

[54] V-TYPE ENGINE

[75] Inventor: Shuichi Mishima, Iwata, Japan

[73] Assignee: Suzuki Kabushiki Kaisha, Japan

[21] Appl. No.: 711,281

[22] Filed: Sep. 12, 1996

[30] Foreign Application Priority Data

Dec. 27, 1995 [JP] Japan ..... 7-341656

[51] Int. Cl.[6] ..... F02B 75/18

[52] U.S. Cl. ..... 123/54.4; 123/195 HC

[58] Field of Search ..... 123/195 P, 195 C, 123/195 HC, 54.4, 547

[56] References Cited

U.S. PATENT DOCUMENTS

| | | | |
|---|---|---|---|
| 1,862,723 | 6/1932 | Summers | 123/184.31 |
| 2,686,506 | 8/1954 | Carpentier et al. | 123/184.33 |
| 2,771,863 | 11/1956 | Porsche et al. | 123/184.33 |
| 3,166,054 | 1/1965 | Conover | 123/54.6 |
| 3,969,893 | 7/1976 | Sakurai et al. | 123/184.33 |
| 4,184,462 | 1/1980 | Hale | 123/65 EM |
| 4,346,676 | 8/1982 | Tyner | 123/41.74 |
| 4,817,566 | 4/1989 | Newman | 123/547 |
| 5,348,499 | 9/1994 | Torigai et al. | 123/195 P |
| 5,476,402 | 12/1995 | Nakai et al. | 123/195 P |
| 5,553,586 | 9/1996 | Koishikawa et al. | 123/54.4 |

FOREIGN PATENT DOCUMENTS 6-264757 9/1994 Japan .

*Primary Examiner*—David A. Okonsky
*Attorney, Agent, or Firm*—Ronald P. Kananen

[57] ABSTRACT

In a V-type engine, a pair of cylinder blocks are arranged in V-shape to form a V-bank therebetween, and a suction device and an exhaust device are arranged in the V-bank. An exhaust passage constituting the exhaust device is formed to the most inner side of the bottom portion of the V-bank and the inlet manifold constituting the suction device is arranged in the space formed by the V-bank and the engine cover, outside the exhaust passage.

19 Claims, 3 Drawing Sheets

V-TYPE ENGINE

BACKGROUND OF THE INVENTION

The present invention generally relates to a V-type engine, and more particularly, a V-type engine having an improved structure or arrangement of its suction and exhaust device.

A V-type engine is generally of a type in which a pair of cylinder blocks are arranged in an opposing manner so as to provide a V-shape. Particularly, it is generally required for an outboard motor to mount an engine having a light weight and compact structure, and for this purpose, a V-type engine has been particularly required for the outboard motor.

In an outboard motor, since an engine and suction and exhaust device are accommodated in an engine case, much care and attention have been paid to the layout or arrangement thereof for achieving the purpose mentioned above.

For example, Japanese Patent Laid-open (KOKAI) Publication No. HEI 6-264757 discloses one example of an arrangement of the suction and exhaust device, in which an exhaust port is formed toward the inside of a V-bank, an exhaust passage communicating with the exhaust port is formed at a portion below the V-bank, and a suction port and a suction passage communicated with the suction port are formed outside the V-bank. The V-bank is formed by the V-shape arrangement of the cylinder blocks.

However, in the conventional layout mentioned above, the suction device particularly projects in a width direction of the engine and, hence, a compact structure is not achieved.

Furthermore, in the conventional layout of the suction and exhaust device, it is troublesome to exchange an ignition plug with a new one as an occasion demands.

SUMMARY OF THE INVENTION

An object of the present invention is to substantially eliminate defects or drawbacks encountered in the prior art described above and to provide a V-type engine having an improved compact structure thereof.

This and other objects can be achieved according to the present invention by providing a V-type engine in which a pair of cylinder blocks are arranged in a V-shape to form a V-bank therebetween, characterized in that a suction device and an exhaust device are arranged in the V-bank.

In a preferred embodiment, the exhaust device is arranged at a bottom portion of the V-bank at a portion most inside of the V-bank and the suction device is disposed outside the exhaust device. The exhaust device is provided with an exhaust passage arranged to the bottom portion of the V-bank at the most inside portion of the V-bank and the suction device is provided with an inner manifold disposed in a space formed by the V-bank and an engine cover.

A fresh air guide tube for introducing fresh air into the engine and a silencer connected to the guide tube are disposed in a space formed by the cylinder blocks, the crank case and the engine cover.

A combustion chamber is formed at a connecting portion between the cylinder head and the cylinder block, and an ignition plug is mounted to the combustion chamber from an outside of the V-bank.

According to the structure described above, the exhaust passage constituting the exhaust device is formed to the most inner side of the bottom portion of the V-bank and the inlet manifold constituting the suction device is arranged in the space formed by the V-bank and the engine cover, outside the exhaust passage. According to such arrangement, the suction device does not extend in the width direction of the engine, thus making compact the engine structure.

Furthermore, the suction port and the inlet manifold communicated with the suction port are not disposed on the outside of the V-bank, that is, they are disposed in the space formed by the cylinder block, the crank case and the engine cover. Therefore, the space can be effectively utilized, for example, by arranging the silencer and the fresh air guide tube.

Since the ignition plug can be mounted from the outside of the V-bank of the cylinder head, the ignition plug can be easily exchanged.

The nature and further features of the present invention will be made more clear from the following descriptions made with reference to the accompanying drawings.

DESCRIPTION OF THE PREFERRED EMBODIMENT

Figure 1:
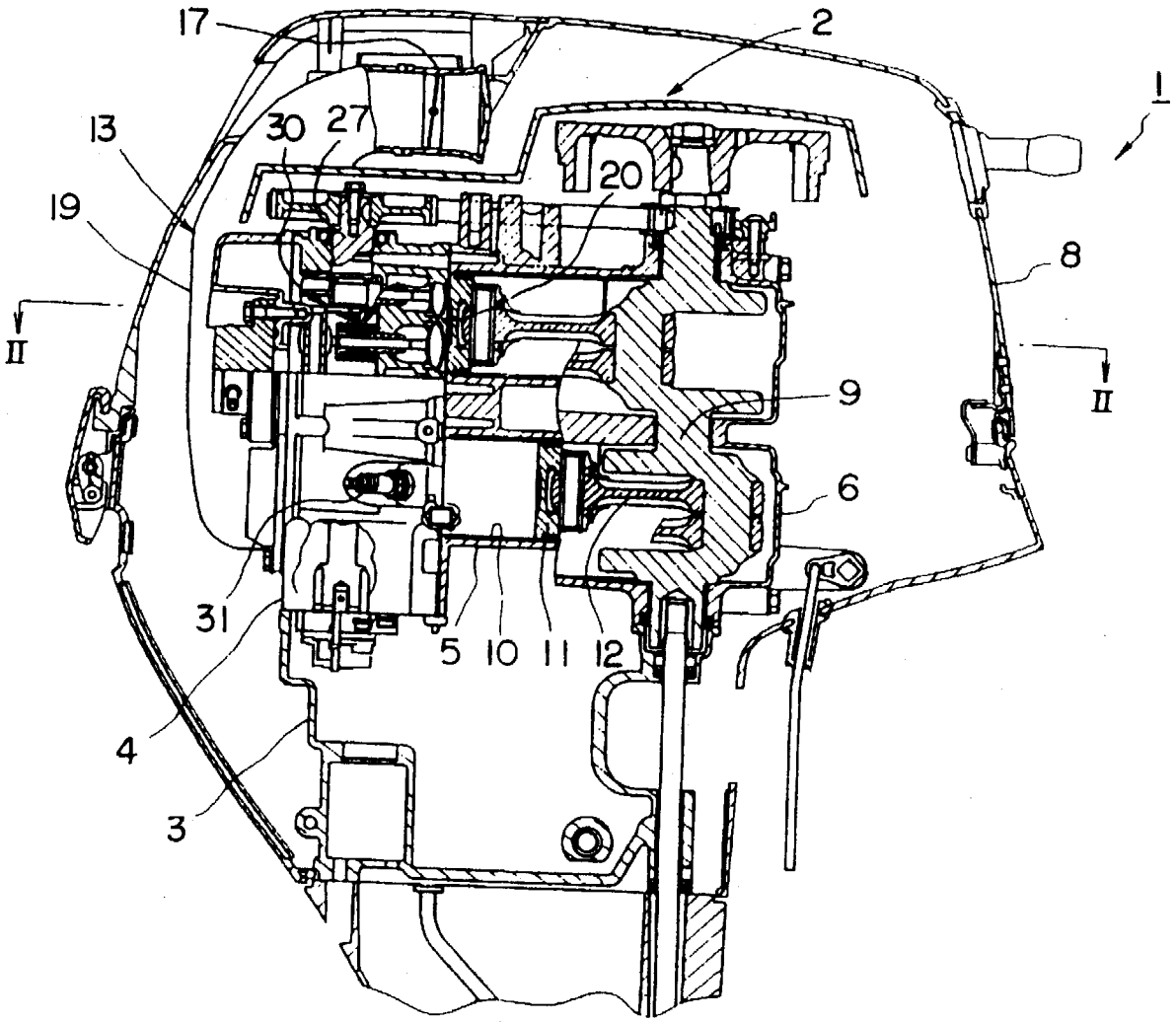
FIG. 1 is an elevational section of an outboard motor engine according to one embodiment of the present invention.
Figure 2:
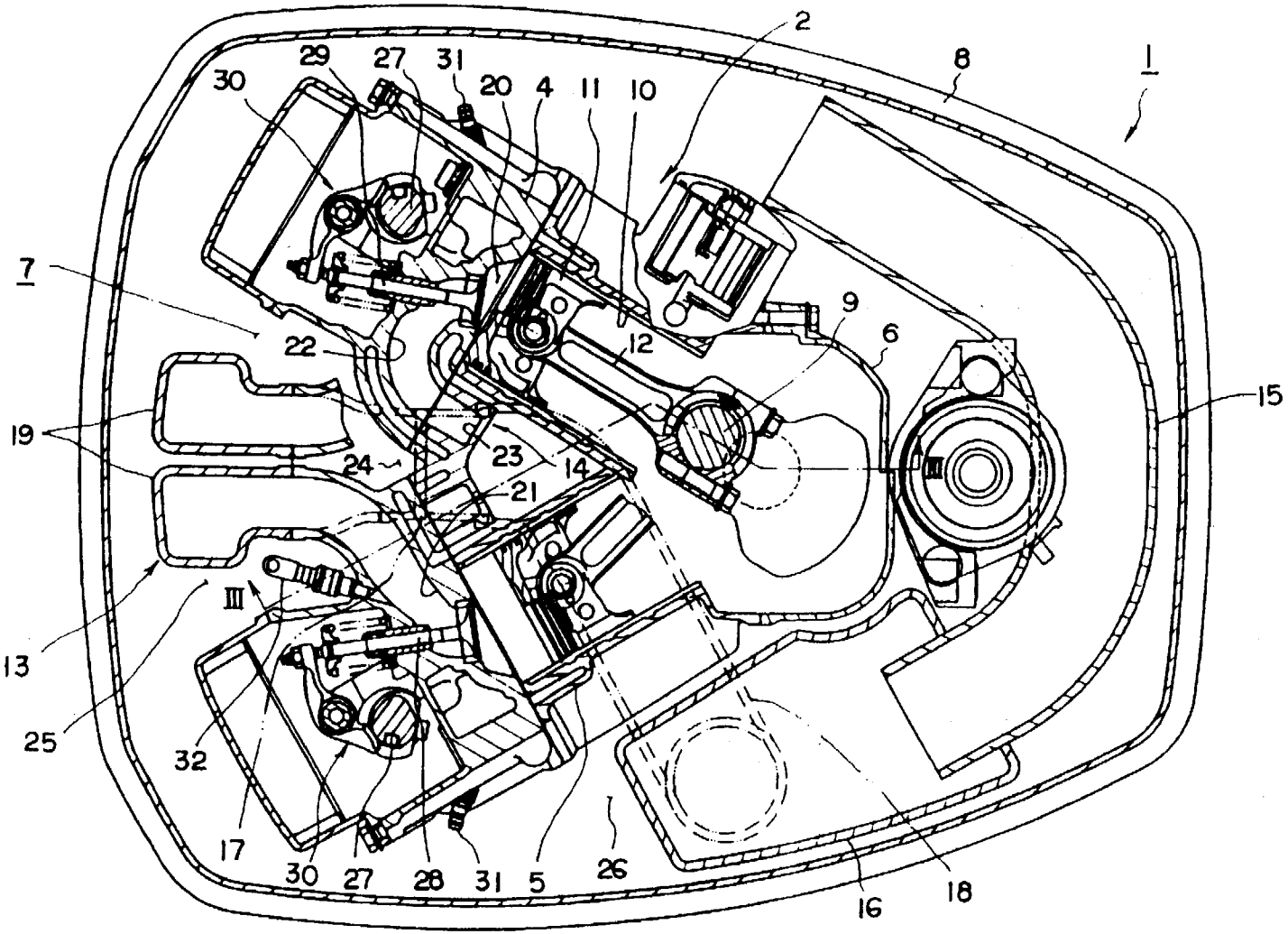
FIG. 2 is a sectional view taken along the line II—II of FIG. 1.
Figure 3:
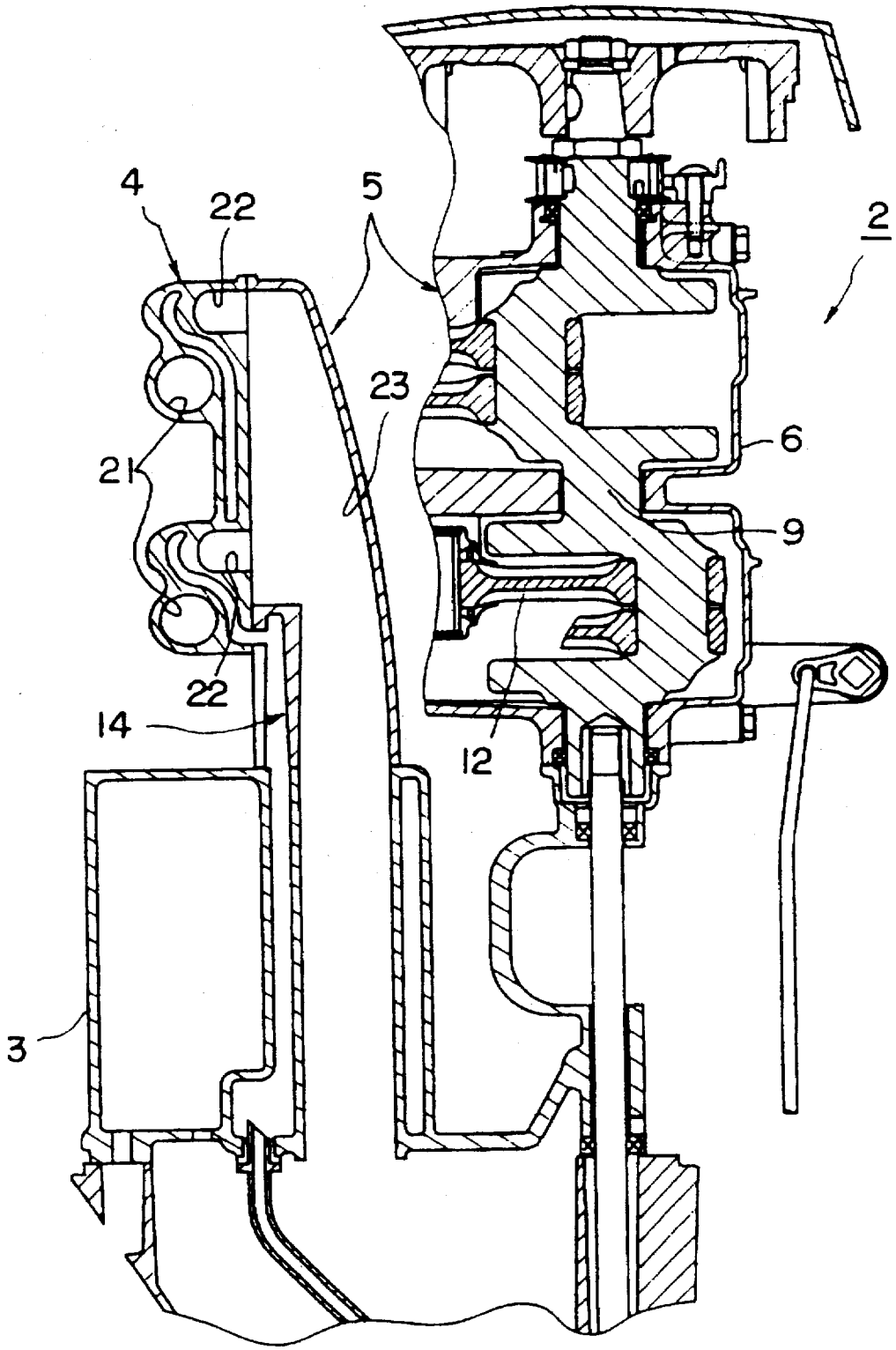
FIG. 3 is also a sectional view taken along the line III—III of FIG. 2.

With reference to FIGS. 1 to 3, a shown outboard motor 1 is provided with an engine 2, which is, for example, of a water-cooled four-stroke-cycle V-type four-cylinder engine, and the engine 2 is mounted on an engine holder 3 in an installed state. The engine 2 is composed, in an assembly, of a cylinder head 4, a cylinder block 5, a crank case 6, and so forth, wherein a pair of cylinder blocks 5 are arranged in V-shape to provide a V-bank 7 between the cylinder blocks 5. The engine 2 is covered by an engine cover 8 substantially entirely.

A crank shaft 9 is supported to be rotatable in the crank case 6 of the engine 2 and cylinders 10 are formed in the cylinder blocks 5, respectively. A piston 11 is inserted into each of the cylinders 10 to be slidable in a direction perpendicular to the crank shaft 9. The piston 11 and the crank shaft 9 are coupled together through a connection rod 12 to thereby convert the reciprocating stroke of the piston into a rotational motion of the crank shaft 9.

The engine 2 is also provided with a suction device 13 and an exhaust device 14.

The suction device 13 is composed of a fresh air guide tube 15 for guiding the fresh air from the outside of the engine 2, a silencer 16 connected to the guide tube 15 for reducing air guiding noise and air pulsation, a connecting tube 18 connecting the silencer 16 and a throttle body for adjusting air amount, inlet manifolds 19 for distributing the air from the throttle body 17 to the respective cylinders 10, and a suction port 21 communicating the inlet manifolds 19 with a combustion chamber 20 formed in the cylinder head 4 at a connecting portion between the cylinder head 4 and the cylinder block 5.

On the other hand, the exhaust device 14 is composed of an exhaust port 22 formed in the cylinder head 4 and communicated with the combustion chamber 20 and an exhaust passage 23 formed to the cylinder block 5 and communicated with the exhaust port 22. Further, it is to be noted that, with reference to FIG. 2, the exhaust device 14 is mainly arranged in the left side of the central portion of the engine 2 and the suction device 13 is mainly arranged in the right side thereof.

Referring to FIG. 2, the exhaust passage 23 is formed at a bottom portion 24 on the most inner side of the V-bank 7, and the inlet manifolds 19 are arranged in a space 25 formed by the V-bank 7 and the engine cover 8, outside the exhaust passage 23. As shown in FIG. 1, the inlet manifolds 19 extend upward and are connected to the throttle body 17 arranged above the engine 2. The silencer 16 and the fresh air guide tube 15 are arranged in a space formed by the cylinder blocks 5, the crank case 6 and the engine cover 8.

A valve moving mechanism 30 composed of a cam shaft 27, a suction valve 28 and an exhaust valve 29 is disposed in the cylinder head 4. An ignition plug 31 is screwed to the central portion of the combustion chamber 20 from the outside of the V-bank 7 of the cylinder head 4. Furthermore, a fuel injector 32 is mounted from the inside of the V-bank 7 so that a fuel is jetted towards the inside of the suction port 21 disposed upstream side of the suction valve 28. In a case where a carburetor is mounted in place of the fuel injector 32, the carburetor will be disposed at a connecting portion between the inlet manifold 19 and the suction port 21.

The embodiment of the present invention of the structure described above will operate in the following manner.

The exhaust passage 23 constituting the exhaust device 14 is formed to the most inner side of the bottom portion of the V-bank 7 and the inlet manifolds 19 constituting the suction device 13 are arranged in the space 25 formed by the V-bank 7 and the engine cover 8, outside the exhaust passage 23. According to such arrangement, the suction device 13 does not extend in the width direction of the engine 2 as in the conventional structure, thus making compact the engine structure.

Furthermore, the suction port 21 and the inlet manifold 19 communicated with the suction port 21 are not disposed on the outside of the V-bank 7, that is, they are disposed in the space 26 formed by the cylinder block 5, the crank case 6 and the engine cover 8, as in the conventional arrangement. Therefore, the space 26 can be effectively utilized, for example, by arranging the silencer 16 and the fresh air guide tube 15 as in the present invention.

Since the ignition plug 31 can be mounted from the outside of the V-bank 7 of the cylinder head 4, the ignition plug 31 can be easily exchanged, thus being advantageous.

What is claimed is:

1. In a V-type engine in which a crank shaft is disposed and a pair of cylinder blocks are arranged in a V-shape to form a V-bank therebetween, the improvement in which a suction device and an exhaust device are arranged in said V-bank, the crank shaft and the cylinder blocks are arranged vertically, an intake port and an exhaust port of the engine are formed inside the V-bank, and a camshaft is disposed inside a cylinder head.

2. A V-type engine according to claim 1, wherein said exhaust device is arranged at a bottom portion of the V-bank at a portion most inside of the V-bank and said suction device is disposed outside the exhaust device.

3. A V-type engine according to claim 2, wherein said exhaust device is provided with an exhaust passage arranged at the bottom portion of the V-bank at the most inside portion of the V-bank and said suction device is provided with an inner manifold disposed in a space formed by the V-bank and an engine cover.

4. A V-type engine according to claim 3, wherein a fresh air guide tube for introducing fresh air into the engine and a silencer connected to the guide tube are disposed in a space formed by the cylinder blocks, a crank case and the engine cover.

5. A V-type engine according to claim 1, wherein a combustion chamber is formed at a connecting portion between the cylinder head and a cylinder block and an ignition plug is mounted to the combustion chamber from outside of the V-bank.

6. A V-type engine according to claim 1, further including a fuel injector disposed in an intake passage inside the V-bank so that fuel is jetted toward the inside of a suction port disposed upstream side of a suction valve.

7. A V-type engine according to claim 1, wherein the exhaust device extends downward.

8. A V-type engine according to claim 3 wherein the inner manifold extends upward.

9. A V-type engine according to claim 3 wherein intake and exhaust manifolds extend in vertically opposing directions.

10. A V-type engine, comprising:

a crank shaft disposed in said engine;

a pair of cylinder blocks arranged in a V-shape to provide a V-bank between the cylinder blocks, the crank shaft and the cylinder blocks arranged vertically;

an engine cover for substantially entirely covering the engine;

a suction device arranged in said V-bank and including a suction port communicating inlet manifolds with a combustion chamber formed in a cylinder head at a connecting portion between a cylinder head and the cylinder block; and an exhaust device arranged in said V-bank and including an exhaust port formed in the cylinder head and communicating with the combustion chamber and an exhaust passage formed in the cylinder block and communicating with the exhaust port, the intake port and the exhaust port formed inside the V-bank, the suction device primarily formed on one side of the engine and the exhaust device primarily formed on the other side of the engine.

11. A V-type engine according to claim 10, wherein the exhaust passage is formed at a bottom portion on the most inner side of the V-bank, and inlet manifolds are arranged in a space formed by the V-bank and the engine cover, outside the exhaust passage.

12. A V-type engine according to claim 11 wherein the inlet manifolds extend upward while exhaust manifolds defining an exhaust passage extend downward.

13. A V-type engine according to claim 11, wherein the suction device includes a fresh air guide tube for guiding fresh air from the outside of the engine, a silencer connected to the guide tube for reducing air guiding noise and air pulsation, a connecting tube connecting the silencer and a throttle body for adjusting air amount, the inlet manifolds distributing the air from the throttle body to the respective cylinders, and the suction port communicating the inlet manifolds with the combustion chamber formed in the cylinder head.

14. A V-type engine according to claim 13, wherein the silencer and the fresh air guide tube are arranged in a space formed by the cylinder blocks, the crank case and the engine cover.

15. A V-type engine according to claim 10, wherein an exhaust passage constituting the exhaust device is formed to the most inner side of the bottom portion of the V-bank and inlet manifolds constituting the suction device are arranged in the space formed by the V-bank and the engine cover outside the exhaust passage, whereupon the suction device does not extend in the width direction of the engine to make the engine structure more compact.

16. A V-type engine according to claim 10, wherein the suction port and the inlet manifold communicated with the suction port are disposed in the space formed by the cylinder block, the crank case and the engine cover.

17. In a V-type engine in which a pair of cylinder blocks are arranged in a V-shape to form a V-bank therebetween, the improvement in which a suction device and an exhaust device are arranged in said V-bank, wherein said exhaust device is arranged at a bottom portion of the V-bank at a portion most inside of the V-bank and said suction device is disposed outside the exhaust device, wherein said exhaust device is provided with an exhaust passage arranged at the bottom portion of the V-bank at the most inside portion of the V-bank and said suction device is provided with an inner manifold disposed in a space formed by the V-bank and an engine cover, and wherein a fresh air guide tube for introducing fresh air into the engine and a silencer connected to the guide tube are disposed in a space formed by the cylinder blocks, the crank case and the engine cover.

18. A V-type engine according to claim 17, wherein the crank shaft and the cylinder blocks are arranged vertically, an intake port and an exhaust port of the engine are formed inside the V-bank, and a camshaft is disposed inside the cylinder head.

19. A V-type engine according to claim 17, wherein a combustion chamber is formed at a connecting portion between the cylinder head and the cylinder block and an ignition plug is mounted to the combustion chamber from an outside of the V-bank.

* * * * *